United States Patent [19]

Baggio

[11] 4,449,273

[45] May 22, 1984

[54] HYDRAULIC DEVICE PARTICULARLY FOR SKI BOOT FASTENING

[75] Inventor: Giorgio Baggio, S. Martino di Lupari, Italy

[73] Assignee: Nordica S.p.A., Montebelluna, Italy

[21] Appl. No.: 340,948

[22] Filed: Jan. 20, 1982

[30] Foreign Application Priority Data

Jan. 28, 1981 [IT] Italy ..... 19384 A/81

[51] Int. Cl.[3] ..... A43B 11/00

[52] U.S. Cl. ..... 24/68 SK; 24/70 SK; 36/117; 36/50

[58] Field of Search ..... 24/68 SK, 69 SK, 70 SK, 24/71 SK, 68 D, 68 R, 69 R, 70 R, 71 R, 298; 254/86 H, 89 H; 36/117, 121, 51, 50; 137/625.41, 625.47, 625.11

[56] References Cited

U.S. PATENT DOCUMENTS

| | | | |
|---|---|---|---|
| 2,335,085 | 11/1943 | Roberts | 137/625.47 |
| 3,315,942 | 4/1967 | Buberniak | 254/86 H |
| 3,350,063 | 10/1967 | Thurlow et al. | 254/86 H |
| 4,051,611 | 10/1977 | Chalmers | 24/68 SK |

*Primary Examiner*—Gene Mancene
*Assistant Examiner*—Kris R. Schulze
*Attorney, Agent, or Firm*—Guido Modiano; Albert Josif

[57] ABSTRACT

The hydraulic device comprises a pumping element which, through a selector assembly, is caused to communicate with one or more driving members provided on a boot and wherewith there is connected a respective hook element for effecting the fastening of the boot, the selector assembly being adapted to allow the releasing of one or all the fastening elements by connecting the respective driving members to a reservoir of a selected working fluid.

3 Claims, 2 Drawing Figures

HYDRAULIC DEVICE PARTICULARLY FOR SKI BOOT FASTENING

BACKGROUND OF THE INVENTION

This invention relates to a hydraulic device particularly for ski boot fastening.

As is known, for ski boot fastening purposes, it is common practice to utilize lever elements provided with hooks, which may have various different configurations and practically effect a fastening action based on the lever principle, in that a long arm is used to overcome the resisting force of a shorter arm.

Presently known lever systems utilize a large variety of criteria for achieving adjustability of the fastening force, but in all cases there exists the need of providing an accurate adjustment through a series of operative steps which require a degree of skilled handling by the user.

A further problem resides in that lever closing is, especially at very low temperatures and hence with fairly rigid materials, generally rather wearisome and not readily to be carried out.

It should be added to the above that boots may be equipped with additional devices, e.g. for changing the fit by the raising of a wedge, or with pressure elements arranged to act on the foot neck portion, or elements for changing the boot inclination, etc., which generally include independent adjustment elements of their own which are implemented by various devices, the operation whereof can be on occasions fairly complex.

SUMMARY OF THE INVENTION

Thus the task of the present invention is to obviate such prior art drawbacks by providing a hydraulic device which enables the boot fastening to be accomplished with the utmost ease and celerity, as well as the actuation of any additional accessory elements which may be provided on the boot.

Within this task it is an object of the invention to provide a hydraulic device which affords the possibility of reliably fastening the boot without requiring any excessive effort by the user, while enabling the applicable fastening force to be controlled with great accuracy and ease.

A further object of this invention is to provide a hydraulic device which, by virtue of its construction, can ensure the highest degree of reliability and safety in use.

Yet another object of this invention is to provide a hydraulic device which has a reduced size and can, therefore, be readily fitted to a standard ski boot.

According to one aspect of the invention, the aforesaid task and objects as well as yet other objects, such as will be apparent hereinafter, are achieved by a hydraulic device particularly for fastening ski boots, characterized in that it comprises a pumping element connected to a conduit arranged to draw in a working fluid reservoir and to a delivery conduit in communication with a selector assembly adapted to selectively connect said delivery conduit to a plurality of driving members associated with a ski boot or to a single driving member in said plurality, there being further provided a return conduit controlled by shut-off valving means and connecting said delivery conduit to said reservoir.

BRIEF DESCRIPTION OF THE DRAWING

Further features and advantages will be more apparent from the following description of a preferred, though not limitative, embodiment of the instant hydraulic device, as illustrated by way of example only in the accompanying drawing, where.

DESCRIPTION OF THE PREFERRED EMBODIMENTS

Figures 1, 2:
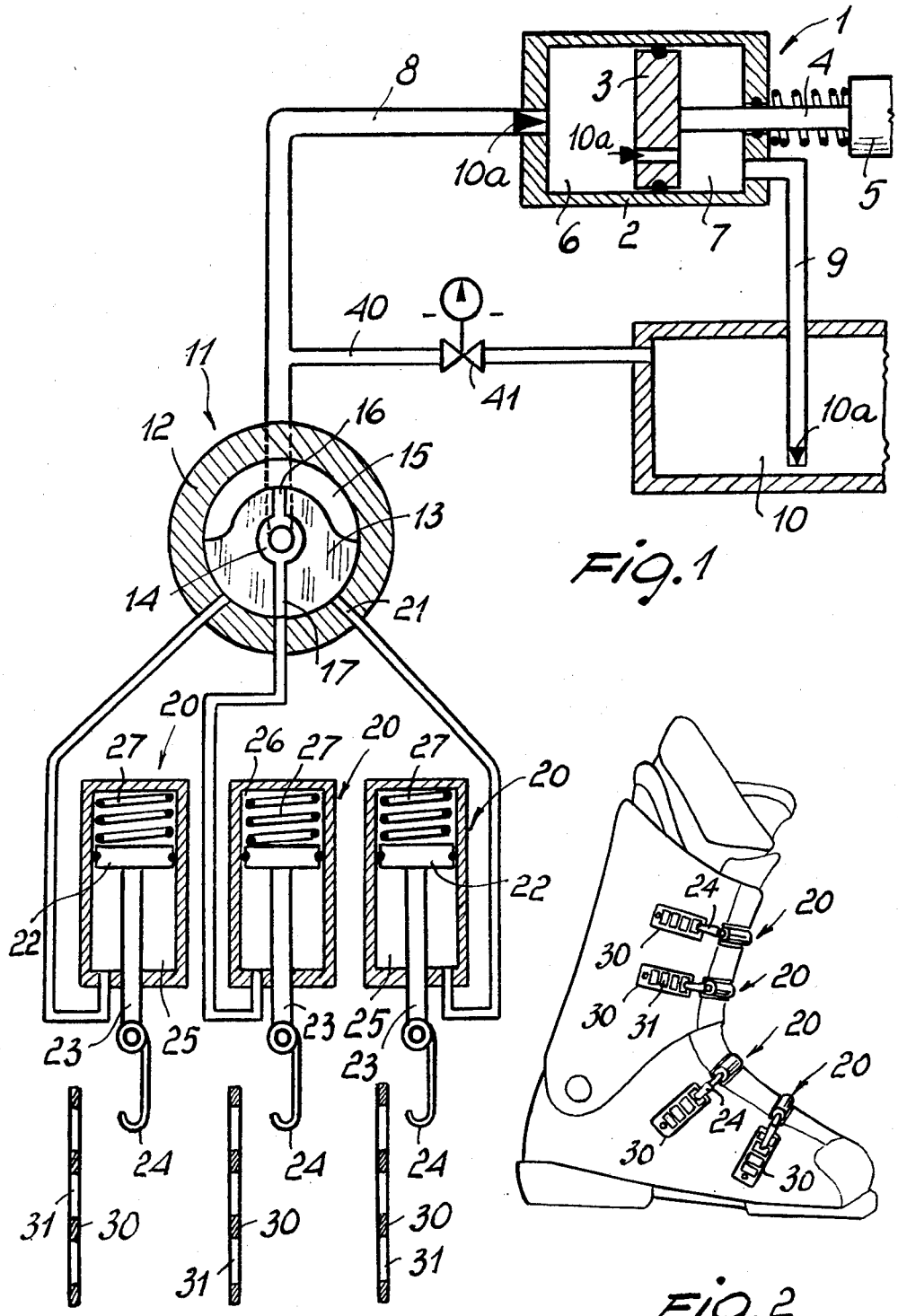
FIG. 1 shows schematically the hydraulic device according to the invention.
FIG. 2 shows a possible application of the hydraulic device to a ski boot.

With reference to the drawing figures, the hydraulic device according to this invention comprises a pumping element, generally designated with the reference numeral 1 which, in the specific example shown, includes a manually operable piston pump. Of course, the type of pumping element or means, and whether it should be manually operated or power driven, will depend each time on the actual contingent requirements.

In detail, the pumping element illustrated has a body 2, on the interior whereof a piston 3 is slidable in sealed relationship which is provided with a piston rod 4 extending out of the body 2 and being terminated in a driving or control knob 5.

The piston 3 divides the chamber defined in the interior of the body 2 into a delivery chamber 6 and intake chamber 7, which are respectively connected to a delivery conduit 8 and latter drawing conduit 9 which a is introduced into a reservoir 10 of the working fluid or liquid.

Moreover, on the piston 3, there are provided one-way valving means 10a which allow the fluid to only flow from the chamber 7 into the chamber 6 and not viceversa, other one-way valve means **10*a* being provided at the inlet of the delivery conduit 8 to only allow the flow from the chamber 6 to the conduit 8 and not viceversa, and at the inlet of the drawing conduit 9, such as to prevent fluid return flows from the chamber 7 into the reservoir 10**.

The delivery conduit 8 is connected to a selector assembly, generally indicated at 11, which includes a fixed hollow cylindrical outer body 12 and an inner selector element 13 which is rotatable relatively to the body 12 in a manner which will be explained hereinafter.

The cited selector assembly 11 communicates with a plurality of fluid-operated driving members or actuators generally indicated at 20, which are associable with a portion of a ski boot for effecting various types of actuations, according to necessity.

To discuss the selector assembly 11 in detail, the movable inner selector element 13 has a central inlet chamber 14 in communication with the delivery conduit 8. At the periphery of the element 13, there is defined an arcuate cutout 15 spanning an area which is substantially equal to the circumferential area affected by the inlets 21 provided on the fixed body 12 for the connection of the various actuators 20 to the selector assembly 11 by means of respective control conduits. Said cutout 15 is put into communication, through a fitting 16, with the central chamber 14. From the central chamber 14, there also extends a radial conduit 17, which is adapted to connect one of the inlets 21, to be selected as desired, to the central chamber 14. As visible in FIG. 1, the inlets 21 of the control conduits extend along directions converging toward the central inlet chamber 14 of the selector assembly 11.

The actuators preferably comprise hydraulic cylinders of small size, on the interior whereof are provided small pistons 22 having respective piston rods 23 which extend out of the cylinder bodies in sealed relationship and are associated, for example, with respective hook elements 24. The pistons 22 divide the inner chambers of the cylinders 20 into respective first chamber 25, communicating with the inlets 21 and selector assembly 11, and respective second chambers 26, wherein respective bias springs 27 are active which effect the return movement of the pistons 22 such as to produce the outflow of the respective working fluid from the first chambers.

As mentioned hereinabove, to each rod 23 there can be coupled a hook element which is engageable with a small plate 30 formed with slits 31. The plates 30 are attached to the boot on another flap or portion to that mounting the small cylinders 20, as the hydraulic device is utilized to fasten a boot.

The cited delivery conduit 8 and thus the selector 11, are connected to a return conduit 40 which is acted upon by a shut-off valve means 41 and which re-enters the reservoir 10.

The selector assembly, and more specifically the movable element 13, can be rotated such as to selectively produce the simultaneous actuation of all the actuators defined by of the cylinders 20, or alternatively, the actuation of a single cylinder.

The operation is extremely simple. In fact, with the shut-off valve 41 in the closed position, by exerting a pumping action on the pumping element 1, the fluid picked up from the reservoir 10 is conveyed through the delivery conduit 8 which introduces it into the selector assembly 11, which, in the position shown in the drawing, introduces it into the corresponding actuator 20, thus producing the translation of the respective piston 22 and consequently the fastening action, with a presettable force, of the corresponding hook 24 which engages with the plate 30.

By suitably rotating the movable element 13 in corresponding angular positions, it becomes possible to operate in succession all the actuators.

Where it is desired to simultaneously actuate all the actuators, it will be sufficient to rotate the movable element 13 in a further angular position such as to bring the cutout 15 into registration with all the inlets 21, thereby the fluid adducted from the delivery conduit 18 is simultaneously introduced into all the actuators 20.

In order to unfasten the boot, or adjust any individual piston, with the selector assembly in the position shown in FIG. 1, by opening the shut-off valve 41, it becomes possible to expel fluid from the corresponding actuator 20, which results in the fluid being returned into the reservoir 10 and the respective piston 22 being translated in the opposite direction under the thrust of the spring 27.

Thus, it is possible to individually release each fastening element.

It should be further added to the foregoing that the cited pumping unit can operate a variable number of pistons or cylinders having different functions, such as for example to change the fit by raising or lowering the wedge, or to act as pushers onto the foot neck portion, or inclination variators.

All these actuators, whether arranged to fasten the boot or to perform other ancillary functions, will converge into the selector 11, thereby the user is always enabled to independently operate each actuator, or alternatively all the actuators at any one time, both during the fastening and releasing steps. As visible in the drawing, the pumping means 1, reservoir 10, selector assembly 11 and driving members 20 are permanently connected to one another. The presence of conduits between the various components advantageously allows to arrange the components in the most suitable position on the boot such as to be easily operable.

It will be appreciated from the foregoing description that the invention achieves its objects, and in particular that the provision of a hydraulic device enables to carry out, where it is utilized for fastening the boot, an extremely quick and accurate fastening which can be differentiated in accordance with the positioning point of the corresponding fastening device and with the contingent requirements.

The invention as conceived is susceptible to many modifications and variations without departing from the scope of the instant inventive concept.

Furthermore, all of the details may be replaced with other technically equivalent elements.

In practicing the invention, the materials employed, and the dimensions and contingent shapes, may be any selected ones for the intended application.

I claim:

1. A device for fastening ski boots, comprising a fluid reservoir, a pumping means connected to said reservoir for pumping fluid out of said reservoir, a selector assembly having an inlet chamber connected to said pumping means for receiving fluid pumped by said pumping means and further connected to said reservoir for returning fluid into said reservoir, valve means associated to said pumping means for allowing feeding of fluid from said reservoir toward said inlet chamber and preventing fluid from passing through said pumping means toward said reservoir, valve means between said selector assembly and said reservoir for controlling return of fluid from said selector assembly to said reservoir, a plurality of fluid-operated driving members arranged on a portion of said ski boot and having means for fastening said portion with another portion of said ski boot, control conduits each connecting one of said driving members with said selector assembly, and means in said selector assembly for selectively connecting at least one of said control conduits with said inlet chamber to operate at least one of said driving members and fastening means.

2. A device as claimed in claim 1, wherein said selector assembly has a fixed hollow cylindrical outer body having a central inlet chamber and said control conduits have inlets connected to said outer body along directions converging toward said central inlet, said selector assembly further having a rotatable cylindrical selector element having a radial conduit for selective connection of one of said control conduits with said central inlet chamber in corresponding angular positions of said rotatable selector element and an arcuate cutout for connection of all said control conduits with said central inlet chamber in a further angular position of said rotatable selector element.

3. A device as claimed in claim 1, wherein said driving members comprise small cylinders and respective small pistons slideable therein, said small pistons dividing said cylinders into respective first chambers communicating with said selector assembly and respective second chambers housing respective bias springs, said small pistons having respective piston rods and hook elements connected to said piston rods, and said another portion of said ski boot having plates each having slits for engagement with a respective one of said hook elements.

* * * * *